US005474467A

United States Patent [19]

Chen

[11] Patent Number: 5,474,467

[45] Date of Patent: Dec. 12, 1995

[54] LAMP SOCKET

[76] Inventor: Ming-Hsiung Chen, 16, Alley 3, Lane 227, Nung-An Street, Taipei, Taiwan

[21] Appl. No.: 251,048

[22] Filed: May 31, 1994

[51] Int. Cl.[6] ..... H01R 4/24

[52] U.S. Cl. ..... 439/419; 439/417

[58] Field of Search ..... 439/395–404, 439/409, 417–419, 611–613, 615

[56] References Cited

U.S. PATENT DOCUMENTS

| | | | |
|---|---|---|---|
| 2,800,635 | 7/1957 | Christenbery | 439/419 |
| 3,130,921 | 4/1964 | Morgan | 439/419 |
| 5,051,877 | 9/1991 | Liao | 439/419 |
| 5,109,324 | 4/1992 | Ahroni | 439/419 |
| 5,389,008 | 2/1995 | Cheng et al. | 439/419 |

*Primary Examiner*—David L. Pirlot
*Attorney, Agent, or Firm*—Ladas & Parry

[57] ABSTRACT

A lamp socket, which includes a socket body to hold the bulb, a socket cap fastened to the socket body to hold down the electric wire and having two hooked bottom retaining rods inserted through holes on a socket body and hooked on the ring contact of the bulb when the bulb is plugged into the socket body, a gasket and two spaced water sealing rubbers to seal the socket body against water, a center contact metal plate and a side contact metal plate mounted within the socket body for connection with the tip and ring contacts of the bulb, a deformable intermediate contact metal spring to connect the ring contact of the lamp bulb to the side contact metal plate. The center contact metal plate can be turned through about 90° angle per step and moved from one conductor of the electric wire to another thereof to make a different contact.

5 Claims, 7 Drawing Sheets

LAMP SOCKET

BACKGROUND OF THE INVENTION

The present invention relates to lamp sockets, and more particularly to a such a lamp socket which seals out water when installed so that electric leakage is prevented and, which is easy to assemble.

Various decorative strings and Christmas tree light sets are well-known and widely used everywhere in the world, more particularly in western countries during Christmas holidays. While using these decorative lighting devices, the requirement for a safety operation is critical. UL and CSA define strict specifications on these products.

The lamp socket for a decorative string or Christmas tree light set is generally comprised of an internally threaded plastic socket body, a plastic socket cap fastened to the socket body to hold down the electric wire, and two contact metal plates mounted within a respective hole on the socket body and disposed in contact with either conductor of the electric wire. When the lamp bulb is threaded into the socket body, the tip and ring contacts of the lamp bulb are respectively connected to the electric wire through the contact metal plates. This structure of lamp socket is functional however, it has drawbacks. One drawback of this structure of lamp socket is that the socket body may expand when hot, causing the lamp bulb disconnected from the contact metal plates. Another drawback of this structure of lamp socket is that the contact metal plates may be forced to deform easily, causing a short circuit. Still another drawback of this structure of lamp socket is that rain water tends to enter the socket body causing an electric leakage. Still another drawback of this structure of socket lamp is that the screw joint of the connection between the socket body and the lamp bulb complicates the assembly process of the decorative strings or Christmas tree light sets.

SUMMARY OF THE INVENTION

The present invention has been accomplished to provide a socket lamp which eliminates the aforesaid drawbacks. According to one aspect of the present invention, the socket cap has two vertical bottom retaining rods, which have vertically spaced hooked portions for holding the ring contact of the lamp bulb so that the lamp bulb can be fastened to the socket body through a plug-in connection. According to another aspect of the present invention, a gasket and two water sealing rubbers are mounted on the socket body at different elevations to seal out rain water. According to still another aspect of the present invention, the center contact metal plate can be turned through 90° angle per step and moved from one conductor of the electric wire to another thereof to make a different contact. According to still another aspect of the present invention, an intermediate contact metal spring is disposed inside the socket body and spaced from the side contact metal plate, which intermediate contact metal spring will be deformed by the ring contact of the lamp bulb when the lamp bulb is fastened to the socket body, causing the ring contact and the side contact metal plate electrically connected. According to still another aspect of the present invention, a contact metal screw socket is mounted within the socket body and retained in position by the socket cap, having a curved projecting strip extended from the topmost edge thereof and spaced from the side contact metal plate, wherein the curved projecting strip is forced by the topmost edge of the ring contact of the lamp bulb to contact the side contact metal plate when the lamp bulb is fastened to the contact metal screw socket, causing the ring contact of the lamp bulb and the side contact metal plate electrically connected; the curved projecting strip is released from the side contact metal plate when the lamp bulb is removed from the contact metal screw socket, causing the circuit broken.

BRIEF DESCRIPTION OF THE DRAWINGS

FIG. 4-1 is similar to FIG. 4 but showing the ring contact of the lamp bulb connected with the intermediate contact metal spring and the side contact metal plate;

DETAILED DESCRIPTION OF THE PREFERRED EMBODIMENT

Figure 1:
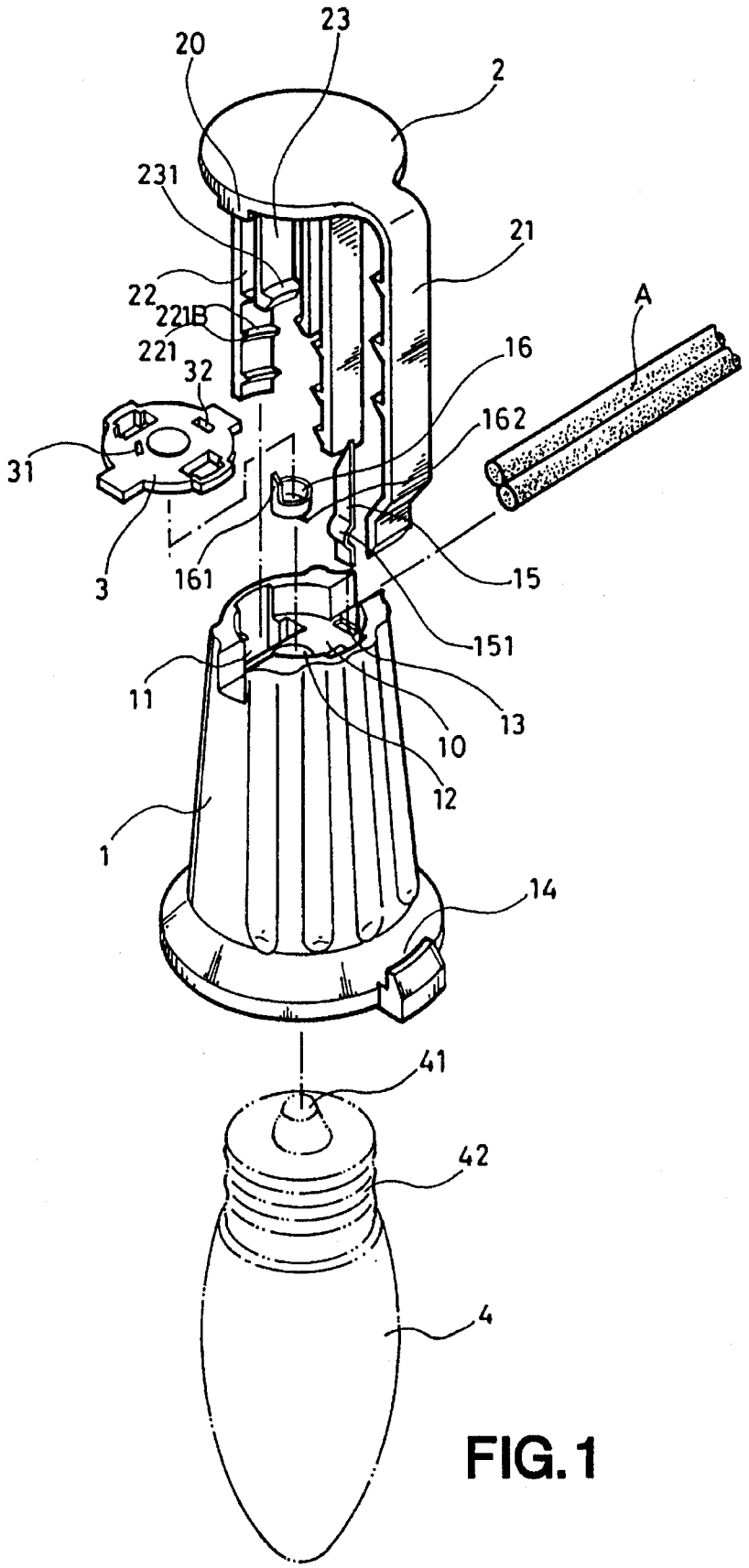
FIG. 1 is an exploded view of a lamp socket according to one embodiment of the present invention.
Figure 2:
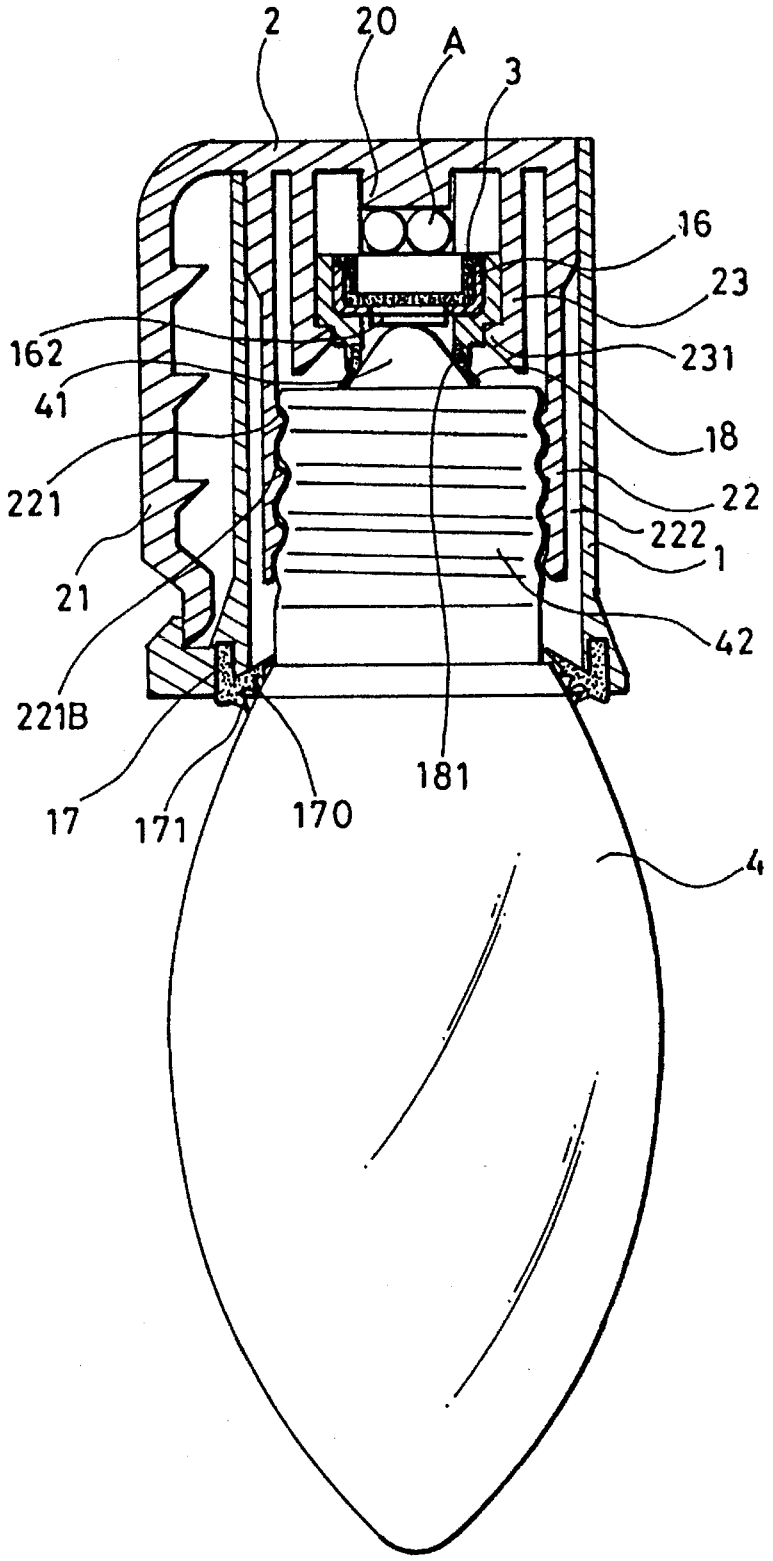
FIG. 2 is a longitudinal view in section of the lamp socket shown in FIG. 2.

Referring to FIGS. 1 and 2, a lamp socket in accordance with the present invention is generally comprised of socket body 1, a socket cap 2 fastened to the socket body 1 at one end, and a gasket 3 retained between the socket body 1 and the socket cap 2.

The socket body 1 comprises a wire groove 10 on the top end thereof for mounting the insulated electric wire A, two slots 11 bilaterally disposed on the wire groove 10, a side through hole 13 through the border of the wire groove 10, a circular center hole 12 through the wire groove 10 at the center, a big water sealing rubber 17 mounted within an annular groove (not shown) on an opposite end (the open end) thereof, which is made of ring-shape having a plurality of annular projections 171 raised around the outside wall of an inward flange 170 thereof, an inside annular flange 181 raised from the inside wall thereof around the circular center hole 12, a small water sealing rubber 18 mounted around the inside annular flange 181 at the bottom, a center contact metal plate 16 fitted into the circular center hole 12 and having a downward projecting strip 162 at the center and an upward projecting tip 161 at one side, a side contact metal plate 15 inserted into the through hole 13 and having a bent 151 near the bottom thereof for connection with the ring contact 42 of the lamp bulb 4. The top end of the side contact metal plate 15 is beveled so that it can pierce the insulated electric wire A to make a contact. The socket cap 2 comprises a press block 20 inserted into the wire groove 10 to hold down the insulated electric wire A, two vertical bottom plug rods 23 and two vertical bottom retaining rods 22 symmetrically disposed at the bottom and respectively inserted into the slots 11 on the socket body 1 to let the socket body 1 and the socket cap 2 be fastened together permitting the insulated electric wire A to be held down by the press block 20, and a clip 21 vertically downwardly extended from the periphery of the close end thereof and inserted into the retaining hole 14 on the socket body 1, wherein each bottom plug rod 23 has a hooked bottom end 231 turned inwards and hooked on the inside annular flange 181 of the socket body 1; each bottom retaining rod 22 has a plurality of vertically spaced hooked portions 221 hooked on the ring contact 42 of the lamp bulb 4; each hooked portion 221 of the bottom retaining rod 22 has a sloping bottom surface so that it can be hooked into the spiral groove around the ring contact 42 of the lamp bulb 4. The gasket 3 comprises two slots 31;32, through which the upward projecting tip 161 of the center contact metal plate 16 and the side contact metal plate 15 pass respectively.

Figure 3:
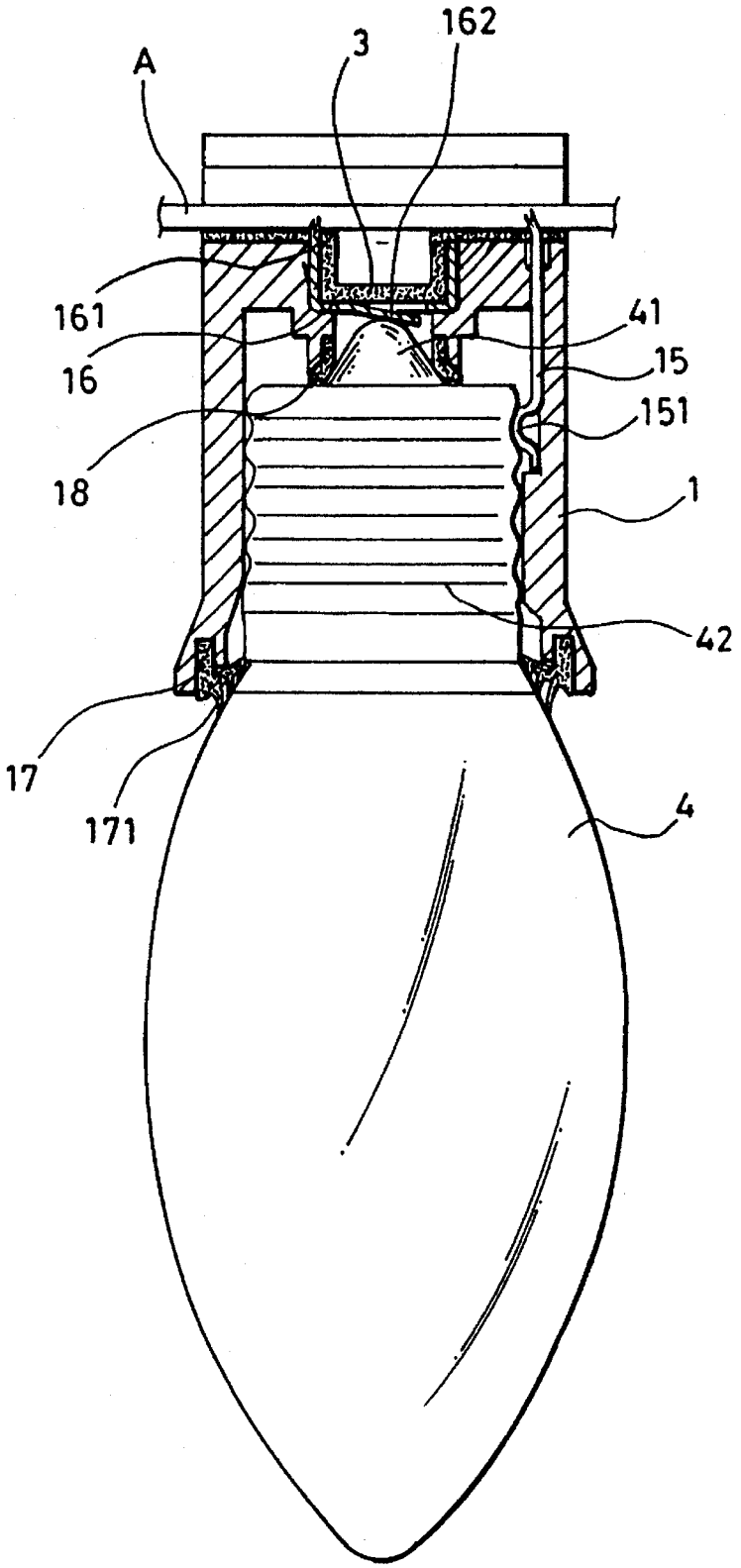
FIG. 3 is another longitudinal view in section of the lamp socket shown in FIG. 2.

Referring to FIG. 3 and FIG. 2 again, before the insulated electric wire A is mounted within the wire groove 10, the gasket 3 is placed on the wire groove 10 permitting the upward projecting tip 161 of the center contact metal plate 16 and the side contact metal plate 15 to extend out of the slots 31 and 32 respectively. When the socket body 1, the socket cap 2 and the gasket 3 are fastened together with the insulated electric wire A retained between the socket cap 2 and the gasket 3, the press block 20 of the socket cap 2 gives a pressure to the electric wire A causing the upward projecting tip 161 of the center contact metal plate 16 and the beveled top end of the side contact metal plate 15 pierce the insulators of the positive and negative conductors of the insulated electric wire A to make a respective contact. When assembled, the bottom end of the slip 21 is inserted into the retaining hole 14. When the lamp bulb 4 is inserted into the socket body 1, the hooked portions 221 of the bottom retaining rods 22 of the socket cap 2 are forced to expand outwards and to project into a receiving space 222 inside the socket body 1. As soon as the lamp bulb 4 is set into position, the bottom retaining rods 22 immediately return to their former shape causing the projecting edge 221B of each hooked portion 221 thereof respectively engaging the ring contact 42 of the lamp bulb 4. When installed, the tip contact 41 and ring contact 42 of the lamp bulb 4 are respectively disposed in contact with the positive and negative conductors of the insulated electric wire 4 through the center contact metal plate 16 and the side contact metal plate 15. Therefore, the mounting of the lamp bulb 4 is easy without through a screw joint. When assembled, the gasket 3 and the big and small water sealing rubbers 17 and 18 seal the lamp socket against rain water to prevent electric leakage. Furthermore, the arrangement of the inside annular flange 181 and the small water sealing rubber 18 allows only the tip contact 41 of the lamp bulb 4 to pass out of the socket body 1 and therefore, no electric shock will happen when the finger is inserted into the socket body 1.

Figure 4:
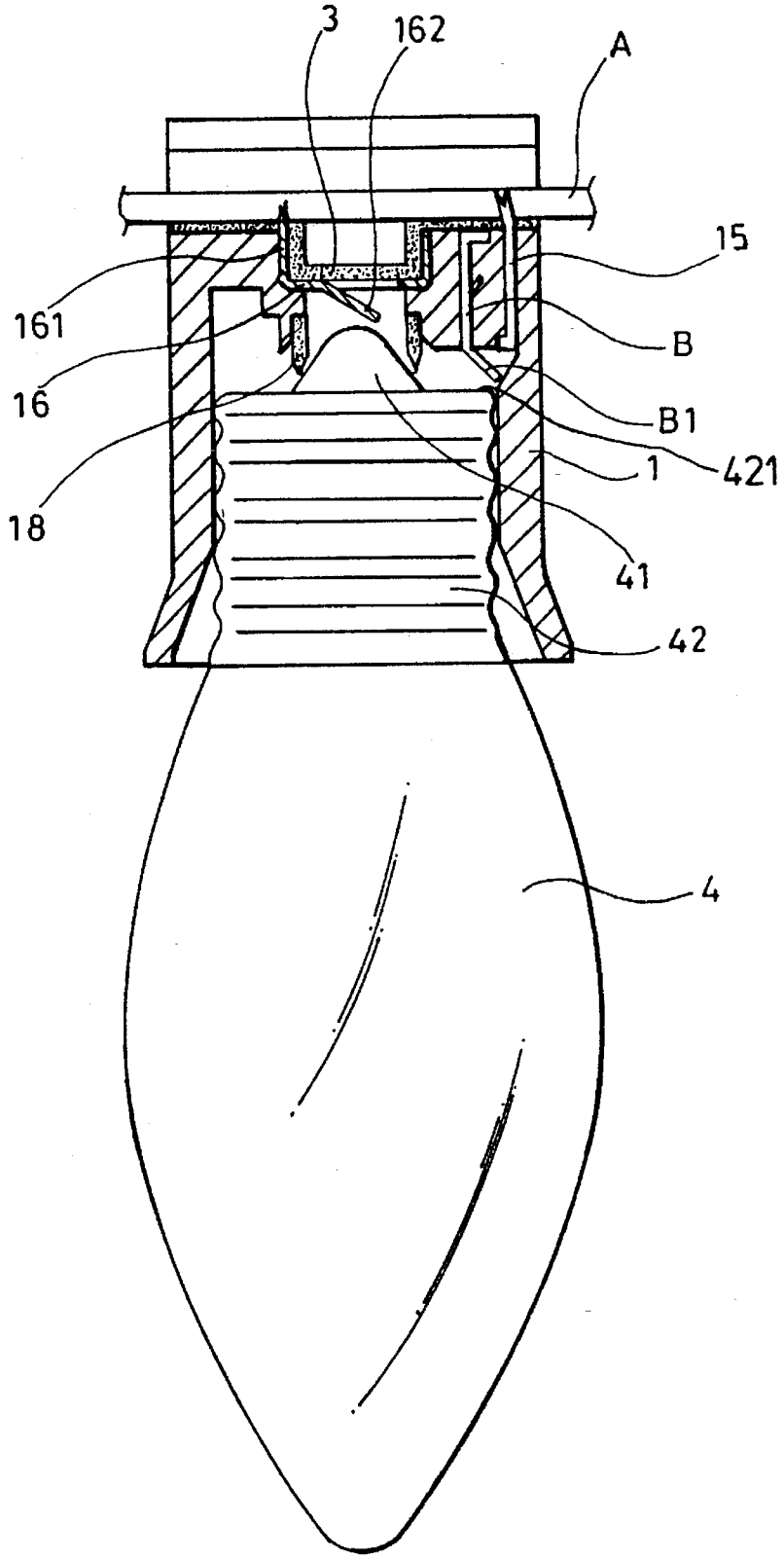
FIG. 4 is a longitudinal view in section of an alternate form of the present invention.
Figure 4A:
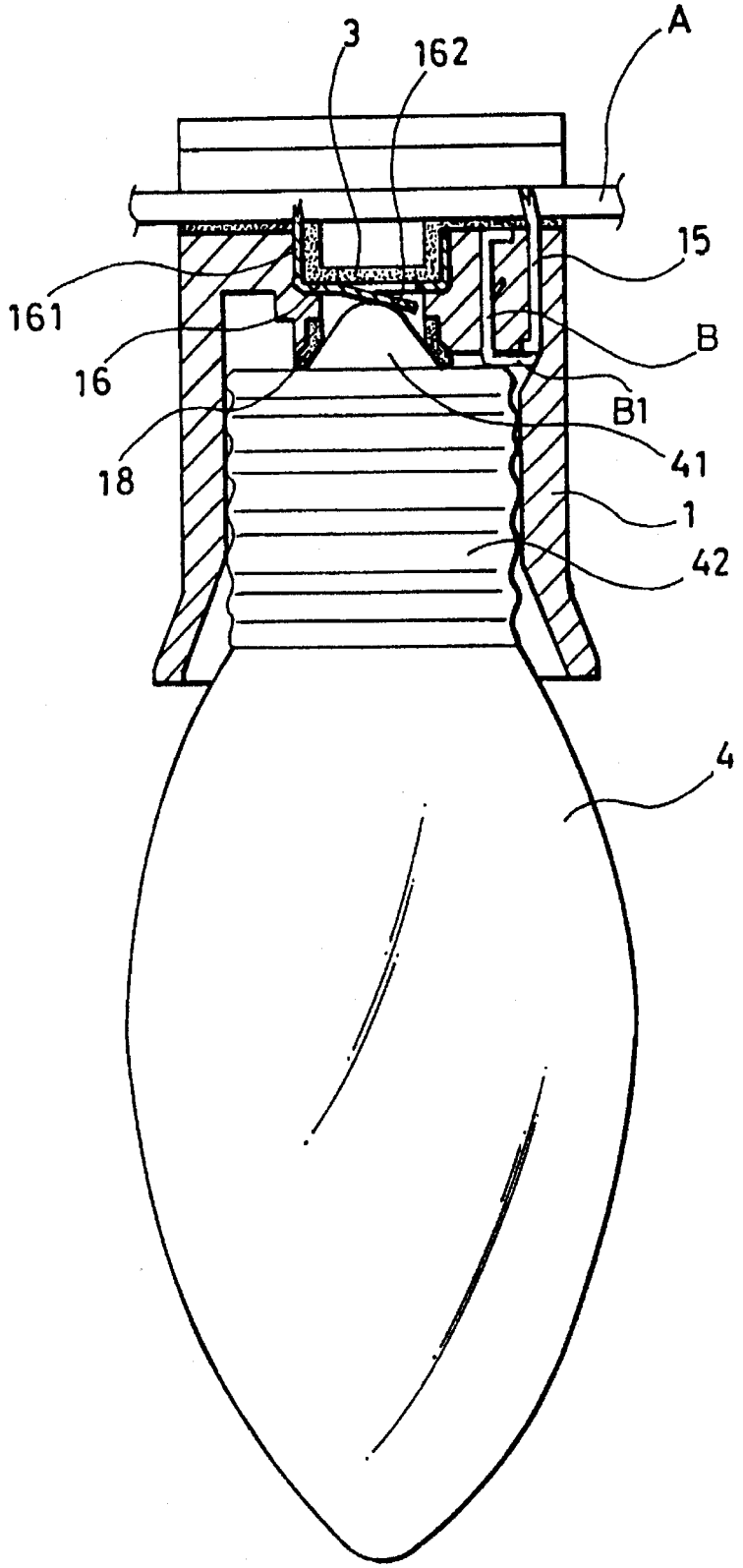

Referring to FIGS. 4 and 4-1, therein illustrated is an alternate form of the present invention. In this alternate form, the side contact metal plate 15 is relatively shorter so that it does not contact the ring contact 42 when the lamp bulb 4 is inserted into the socket body 1. In order to connect the ring contact 42 of the lamp bulb 4 with the side contact metal plate 15, an intermediate contact metal spring B is disposed inside the socket body 1 between the center contact metal plate 16 and the side contact metal plate 15. When the lamp bulb 4 is inserted into the socket body 1, the sloping bottom end B1 of the intermediate contact metal spring B is forced upwards by the top edge 421 of the ring contact 42 of the lamp bulb 4 causing the ring contact 42, the intermediate contact metal spring B and the side contact metal plate 15 electrically connected. When the lamp bulb 4 is removed from the socket body 1, the sloping bottom end B1 of the intermediate contact metal spring B immediately returns to its former position and therefore, the intermediate contact metal spring B and the side contact metal plate 15 are disconnected from each other. No electric shock will happen due to the side contact metal plate 15 is short enough to be reached by finger.

Figure 5:
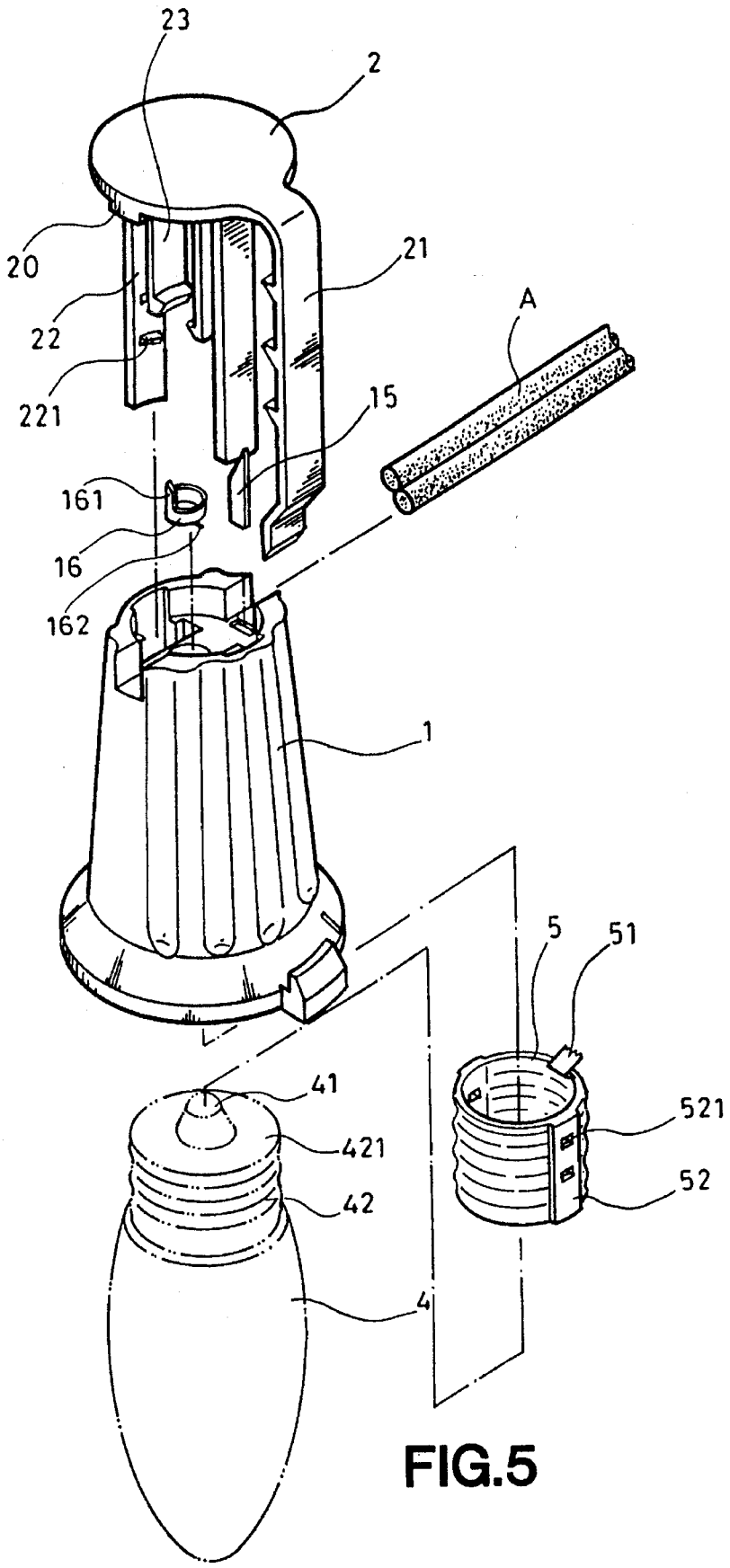
FIG. 5 is an exploded view of another alternate form of the present invention.

Referring to FIG. 5, therein illustrated is still another alternate form of the present invention. In this alternate form, a contact metal screw socket 5 is installed within the socket body 1. The contact metal screw socket 5 comprises a plurality of hook holes 521 vertically spaced on two opposite vertical planes 52 thereof, and a curved projecting strip 51 extended from the topmost edge thereof. When assembled, the curved projecting strip 51 does not contact the side contact metal plate 15, and the hooked portions 221 of the vertical bottom retaining rods 22 respectively hooked in the hook holes 521 on the contact metal screw socket 5 to hold down the contact metal screw socket 5 in position. When the lamp bulb 4 is threaded into the contact metal screw socket 5, the curved projecting strip 51 of the contact metal screw socket 5 is forced by the top edge 421 of the ring contact 42 of the lamp bulb 4 to contact the side contact metal plate 15 and therefore, the ring contact 42 and the side contact metal plate 15 are electrically connected. When the lamp bulb 4 is removed from the contact metal screw socket 5, the curved projecting strip 51 immediately returns to its former shape and therefore, the curved projecting strip 51 and the side contact metal plate 15 are disconnected from each other. No electric shock will happend when the finger is inserted into the socket body 1 to touch the contact metal screw socket 5.

Figure 6:
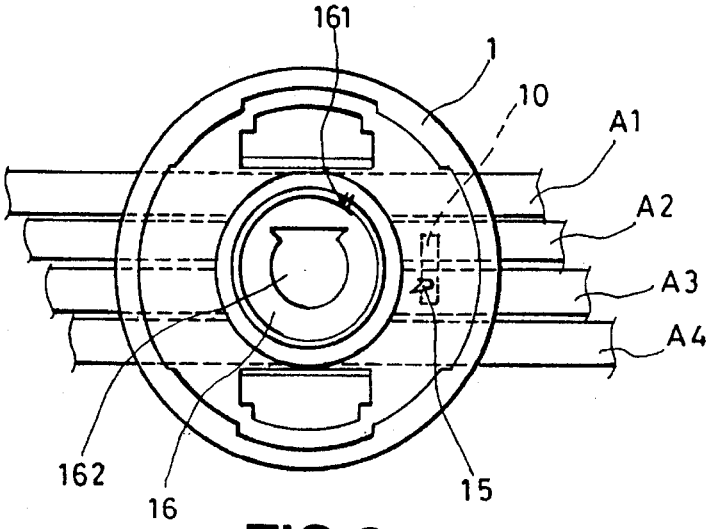
FIG. 6 is a plain view showing the lamp socket of the present invention connected with a four-conductor wire.
Figure 7:
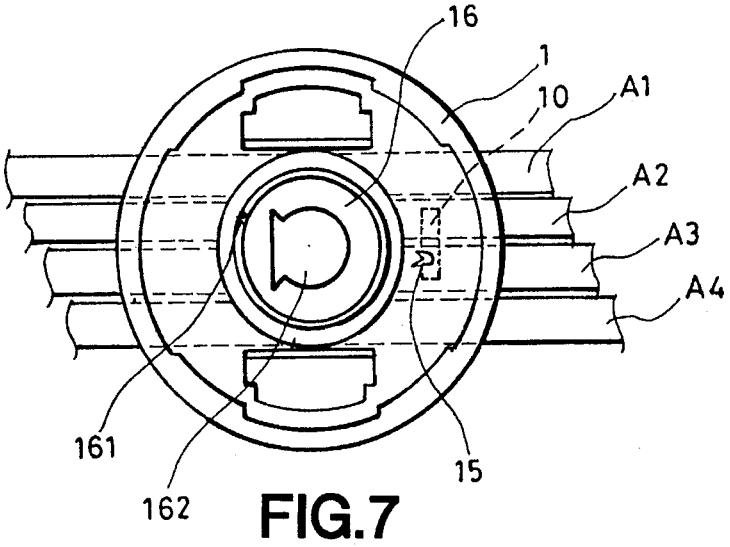
FIG. 7 is similar to FIG. 6 but showing an alternate arrangement of the connection between the electric wire and the center contact metal plate of the lamp socket.
Figure 8:
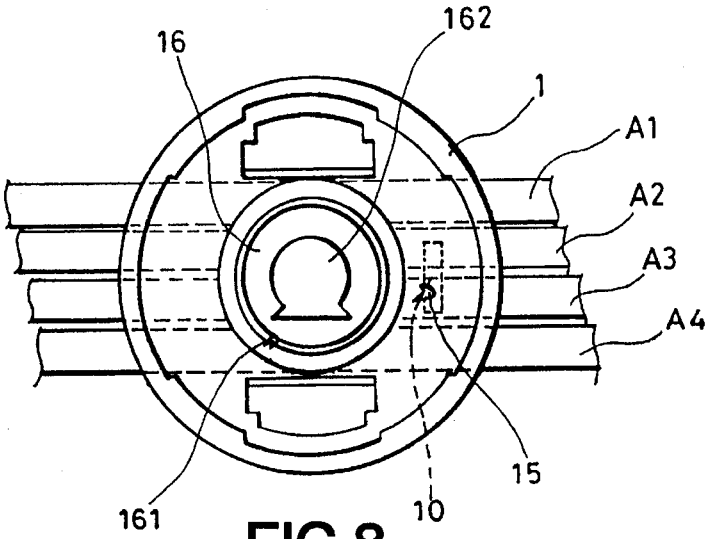
FIG. 8 is similar to FIG. 6 but showing another alternate arrangement of the connection between the electric wire and the center contact metal plate of the lamp socket.

Referring to FIGS. 6, 7, and 8, the present invention is practical for connection with a multiconductor wire and controlled by an electronic flash control circuit. As shown in FIG. 6, the side contact metal plate 15 pierces the insulator of the third conductor A3 to make a contact, the upward projecting tip 161 of the center contact metal plate 16 pierces the insulator of the first conductor A1. When the center contact metal plate 16 is turned through about 90° angle, the upward projecting tip 161 pierces the insulator of the second conductor A2 as shown in FIG. 7. When the center contact metal plate 16 is turned further through about 90° angle, the upward projecting strip 161 pierces the insulator of the fourth conductor A4 as shown in FIG. 8.

While only few embodiments of the present invention have been shown and described, it will be understood that various modifications and changes could be made without departing from the spirit and scope of the invention.

What is claimed is:

1. A lamp socket of the type comprising a socket body having a wire groove on one end thereof, two slots bilaterally disposed through said wire groove, a circular center hole through said wire groove at a center thereof, a side through hole through a border of said wire groove, a big water sealing rubber mounted within an annular groove on an opposite end thereof and fitting the ring contact of the lamp bulb inserted therein to seal a gap between said socket body and a ring contact of said lamp bulb, an inside annular flange raised from an inside wall thereof around said circular center hole, a small water sealing rubber mounted around said inside annular flange to seal the gap, a center contact metal plate fitted into said circular center hole and having an upward projecting tip at one side thereof piercing the insulator of one conductor of the insulated electric wire and being mounted within said wire groove and making contact and a downward projecting strip at a center thereof received within said circular center hole and disposed in contact with the tip contact of said lamp bulb, a side contact metal plate inserted into the through hole on a border of said wire groove and having a beveled top end piercing the insulator of another conductor of said electric wire and making contact and a bend near a bottom thereof connected to the ring contact of said lamp bulb; a gasket mounted within said wire groove and having holes for passing the upward projecting tip of said center contact metal plate and the beveled top end of said side contact metal plate; and a socket cap having a press block pressed on said electric wire against said gasket to hold down said electric wire in said wire groove, two vertical bottom plug rods respectively hooked in two opposite slots on said wire groove, two vertical bottom retaining rods respectively inserted into the two opposite slots on said wire groove and having each a plurality of vertically spaced hooked portions respectively hooked on the ring contact of said lamp bulb.

2. The lamp socket of claim 1 wherein said first water sealing rubber has a plurality of annular projections raised around an outside wall of an inward flange thereof and fitting around the ring contact of said lamp bulb to seal out rain water.

3. The lamp socket of claim 1 further comprising an intermediate contact metal spring disposed inside said socket body and spaced between said side contact metal plate and said center contact metal plate, said intermediate contact metal spring having a sloping bottom end, the sloping bottom end of said intermediate contact metal spring being forced to deform and to contact said side contact metal plate when said lamp bulb is fastened to said socket body, causing the ring contact of said lamp bulb and said side contact metal plate to be electrically connected, the sloping bottom end of said intermediate contact metal spring immediately returning to its former shape and released from said side contact metal plate when said lamp bulb is removed from said socket body.

4. The lamp socket of claim 1 further comprising a contact metal screw socket retained within said socket body by said vertical bottom retaining rods to hold said lamp bulb, said contact metal screw socket comprising a plurality of hook holes vertically spaced on two opposite vertical planes thereof, which receive the hooked portions of said vertical bottom retaining rods respectively, and a curved projecting strip extended from a topmost edge thereof and spaced from said side contact metal plate, said curved projecting strip being forced by the topmost edge of the ring contact of said lamp bulb to contact said side contact metal plate when said lamp bulb is fastened to said contact metal screw socket, causing the ring contact of said lamp bulb and said side contact metal plate to be electrically connected, said curved projecting strip immediately returning to its former shade and released from said side contact metal plate when said lamp bulb is removed from said contact metal screw socket.

5. The lamp socket of claim 1 wherein said center contact metal plate can be turned through about a 90° angle and moved from one conductor of said electric wire to another thereof to make a different contact.

* * * * *